US008985126B2

(12) United States Patent
Förster et al.

(10) Patent No.: US 8,985,126 B2
(45) Date of Patent: Mar. 24, 2015

(54) WASH ARM ARRANGEMENT FOR A DISHWASHER

(75) Inventors: Sarah Förster, Hamburg (DE); Anders Haegermarck, Trangsund (SE); Niklas Olson, Stockholm (SE)

(73) Assignee: Electrolux Home Products Corporation N.V., Brussels (BE)

( * ) Notice: Subject to any disclaimer, the term of this patent is extended or adjusted under 35 U.S.C. 154(b) by 74 days.

(21) Appl. No.: 13/699,440

(22) PCT Filed: May 17, 2011

(86) PCT No.: PCT/EP2011/057970

§ 371 (c)(1),
(2), (4) Date: Jan. 31, 2013

(87) PCT Pub. No.: WO2011/147716

PCT Pub. Date: Dec. 1, 2011

(65) Prior Publication Data

US 2013/0284216 A1 Oct. 31, 2013

(30) Foreign Application Priority Data

May 25, 2010 (EP) ..... 10005406

(51) Int. Cl.

| | |
|---|---|
| ***A47L 15/18*** | (2006.01) |
| ***A47L 15/20*** | (2006.01) |
| ***A47L 15/22*** | (2006.01) |
| ***A47L 15/23*** | (2006.01) |

(52) U.S. Cl.

CPC ..... *A47L 15/23* (2013.01); *A47L 15/20* (2013.01); *A47L 15/22* (2013.01); *A47L 15/18* (2013.01)

USPC ..... 134/179; 134/56 D; 134/57 D; 134/58 D; 134/172; 134/181; 134/198; 134/200

(58) Field of Classification Search

CPC ..... A47L 15/18; A47L 15/20; A47L 15/22; A47L 15/23

See application file for complete search history.

(56) References Cited

U.S. PATENT DOCUMENTS

| | | | | |
|---|---|---|---|---|
| 6,263,888 | B1 * | 7/2001 | Nomura et al. | 134/57 D |
| 2008/0276975 | A1 * | 11/2008 | Disch et al. | 134/176 |
| 2011/0203619 | A1 * | 8/2011 | Kara et al. | 134/174 |

FOREIGN PATENT DOCUMENTS

| | | |
|---|---|---|
| DE | 44 16 655 | 11/1995 |
| EP | 0 469 184 | 2/1992 |

(Continued)

OTHER PUBLICATIONS

International Search Report for Application No. PCT/EP2011/057970, dated Oct. 31, 2011.

*Primary Examiner* — Joseph L Perrin
*Assistant Examiner* — Levon J Shahinian
(74) *Attorney, Agent, or Firm* — Alston & Bird LLP

(57) ABSTRACT

A wash arm arrangement (20) for a dishwasher is disclosed. The wash arm arrangement comprises a central arm (21) adapted to be rotatably connected with a first shaft (23) through which liquid under pressure is fed into the central arm during operation. A second shaft (24) is arranged on the central arm to provide liquid to a satellite arm (22) which is rotatably connected with the second shaft. The satellite arm comprises a collimating nozzle (25) with an exit. The collimating nozzle is arranged for providing a collimated jet for distributing liquid to a washing area of the dishwasher. The inventive concept is based on an understanding that by utilizing a collimated liquid jet with sufficient pressure and flow a good cleaning performance is achieved with a reduced water consumption.

15 Claims, 5 Drawing Sheets

(56) References Cited

FOREIGN PATENT DOCUMENTS

| | | | | |
|---|---|---|---|---|
| EP | 0 988 824 | 3/2000 | | |
| EP | 1 510 168 | 3/2005 | | |
| EP | 1 634 526 | 3/2006 | | |
| FR | 2 505 643 | 11/1982 | | |
| WO | WO 2009021626 A1 * | 2/2009 | ..... | A47L 15/22 |

* cited by examiner

WASH ARM ARRANGEMENT FOR A DISHWASHER

CROSS REFERENCE TO RELATED APPLICATIONS

This application is a national stage application filed under 35 U.S.C. 371 of International Application No. PCT/EP2011/057970, filed May 17, 2011, which claims priority from European Patent Application No. 10005406.3, filed May 25, 2010, each of which is incorporated by reference herein in its entirety.

TECHNICAL FIELD

The present invention relates to a wash arm arrangement for a dishwasher, and more particularly to a wash arm arrangement comprising a satellite arm arranged on a central arm.

BACKGROUND OF THE INVENTION

Most conventional dishwashers are arranged having single wash arm arrangements comprising a central arm which is provided with a plurality of spray nozzles. The spray nozzles are typically arranged along the extension of the central arm for sufficient covering of the washing area of the treatment chamber with cleaning liquid and optionally for driving the central arm. The central arm is rotatably connected with a supply shaft for supply of the cleaning liquid, e.g. water, about which supply shaft the central arm revolves while water is spread within the treatment chamber of the dishwasher.

Further, wash arm arrangements with an additional second arm, herein after referred to as a satellite arm, arranged on one or both of the outer ends of the central arm are known. EP1 634 526 A discloses a wash arm arrangement for a dishwasher, having a central arm onto which a satellite arm is arranged. The central arm is attached at one end to a hollow central shaft which serves as a water and rinsing fluid supply duct. The central arm can be positioned either at the bottom or at the ceiling of the dishwasher treatment chamber. A spray arm is swivel mounted with its center to the outer end of the central arm thereby forming the satellite arm. The spray arm is provided with several nozzles at both ends. The nozzles are arranged having different spray angles for covering the different areas of the washing area of the treatment chamber with cleaning liquid and for driving the spray arm. When the cleaning liquid is released a thrust is created moving both arms in circles around their individual axis of rotation.

Both in single wash arm arrangements and wash arm arrangement with a satellite arm, the spray arms are typically provided with a plurality of nozzles which are spread out on the wash arm arrangement for providing cleaning liquid over the major part of the washing area of the treatment chamber, thereby achieving a high coverage of the washing area. The nozzles may in addition be utilized for making the spray arm and/or central arm rotate. These functionalities of the nozzles, alone and in combination, result in using large amounts of cleaning liquid during operation of the dishwasher which is negative from environmental and economic perspectives.

SUMMARY

In view of the above, an objective of the invention is to solve or at least reduce the problem discussed above. In particular, an objective is to provide a wash arm arrangement which provides a low cleaning liquid consumption combined with a good cleaning performance. The inventive concept is based on an understanding that by utilizing a collimated liquid jet with sufficient pressure and flow a good cleaning performance is achieved with a reduced water consumption.

According to a first aspect of the present invention, there is provided a wash arm arrangement for a dishwasher comprising a central arm adapted to be rotatably connected with a first shaft through which liquid under pressure is fed into the central arm during operation, and at least one satellite arm having a liquid inlet, which is rotatably connected with a second shaft arranged on the central arm for supplying liquid to the satellite arm during operation. The at least one satellite arm comprises a collimating nozzle with an exit arranged for providing a collimated jet for distributing liquid to a washing area of the dishwasher.

Thus, there is provided a wash arm arrangement for a dishwasher which has a collimating nozzle provided on the satellite arm, and which is arranged such that the washing area of the dishwasher is subjected to a collimated uniform liquid jet instead of sprinkled liquid. The collimated liquid jet provides an increased cleaning efficiency on the dishes, and is thus applicable for loosening soil from the dishes in the washing area. Further, the collimated liquid jet simultaneously supplies a sufficient flow of cleaning liquid onto the washing area. The liquid flow needs to be high enough to provide disposal of loosened soil from the washing area. By arranging the collimating nozzle on a satellite arm, a good covering of the washing area is achieved as the liquid jet provided by the rotating satellite arm, which in turn moves with the rotation of the central arm, rotates over the washing area.

According to an embodiment of the wash arm arrangement, the exit is arranged having a predetermined diameter selected for outputting a collimated jet of liquid with a substantially uniform cross-section. The diameter of the collimating nozzle is selected to be sufficiently large such that the liquid flow and pressure created in the hydraulic system formed by the liquid supply system which is connected to the first shaft for supplying the liquid under pressure during operation and the wash arm arrangement is balanced thereby providing a collimated jet from the exit.

According to an embodiment of the wash arm arrangement, the predetermined diameter is selected within a range of 3.5-7.5 mm.

According to an embodiment of the wash arm arrangement, the collimating nozzle is shaped like a hollow, truncated cone with rounded side wall, like a trumpet shape, of which the truncation is arranged for providing the exit for the collimated liquid jet. The cone or trumpet shape of the collimating nozzle is advantageous for collimating and speeding up the cleaning liquid jet before it exits the collimating nozzle. Further, these shapes may provide a smooth guiding of the liquid jet in a desired direction.

According to an embodiment of the wash arm arrangement, the satellite arm is arranged having at least two separate liquid supply channels arranged to provide fluid communication between the liquid inlet and the collimating nozzle, and converging at a collimation portion arranged at the collimating nozzle. During operation of the dishwasher, the resulting cleaning liquid jet out from the collimating nozzle is the converged contributions from the respective liquid supply channels. Each supply channel guides and speeds up the cleaning liquid from the second supply shaft to the collimating nozzle. At the collimation portion, the guided cleaning liquid from the respective liquid supply channels are converged to a collimated, homogenous liquid jet. The liquid jet is outputted from the collimating nozzle via the exit and subsequently subjects the washing area, and the dirty dishes, with a balanced ratio between the impact force of the jet and the liquid volume flow, which in turn provides a very good cleaning result.

According to an embodiment of the wash arm arrangement, the collimation portion comprises a control element for redirecting liquid supplied via each one of the liquid supply channels into a common direction. The control element may be integrated in the design of the collimation portion to support the converging of the individual contributions of cleaning liquid into one homogenous beam, by smoothly redirecting them towards the collimating nozzle which is favorable to create a converged, homogenous and accelerated common jet. The control element may alternatively be provided as a freestanding part arranged at or within the collimation portion.

According to an embodiment of the wash arm arrangement, the control element is further arranged for merging liquid supplied via each one of the liquid supply channels into a common jet. The common jet subsequently exits the collimating nozzle without breaking up into a spread sprinkle.

The supply channels, the trumpet shape of the nozzle and the control element cooperate to contribute to the collimation of the jet. When the water in the supply channels meet, the force vectors in the water are dampened, such that the water is easier to guide in the desired direction.

According to an embodiment of the wash arm arrangement, the collimating nozzle is arranged to provide a propulsion force for driving at least the rotation of the satellite arm around its axis of rotation during operation. This way the amount of liquid needed to drive the wash arm arrangement is minimized with a retained high enough liquid pressure and addition a high enough liquid flow to ensure a good cleaning result.

According to an embodiment of the wash arm arrangement, the collimating nozzle is skewed to provide the propulsion force, which is advantageous.

According to an embodiment of the wash arm arrangement, the collimating nozzle is skewed between 2-20° with respect to the vertical plane of the satellite arm.

According to an embodiment of the wash arm arrangement, the collimating nozzle is arranged at an outer end of the satellite arm.

According to an embodiment of the wash arm arrangement, the second shaft is arranged at an outer end of the central arm.

According to an embodiment of the wash arm arrangement, the wash arm arrangement further comprises an additional collimating nozzle. The additional nozzle may be provided symmetrically on an opposite side of the satellite arm when the satellite arm is rotatably connected with a second shaft at its center, which is advantageous for balancing purposes. Alternatively the additional collimating nozzle may be arranged at a different radial distance with respect to the second shaft then the collimating nozzle for providing a more dense trace pattern of the liquid jets over the washing area.

According to a second aspect of the inventive concept there is provided a dishwasher comprising at least one wash arm arrangement according to the present inventive concept.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of said element, device, component, means, step, etc., unless explicitly stated otherwise.

Other objectives, features and advantages of the present invention will appear from the following detailed disclosure, from the attached dependent claims as well as from the drawings.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DETAILED DESCRIPTION OF PREFERRED EMBODIMENTS

Figure 1:
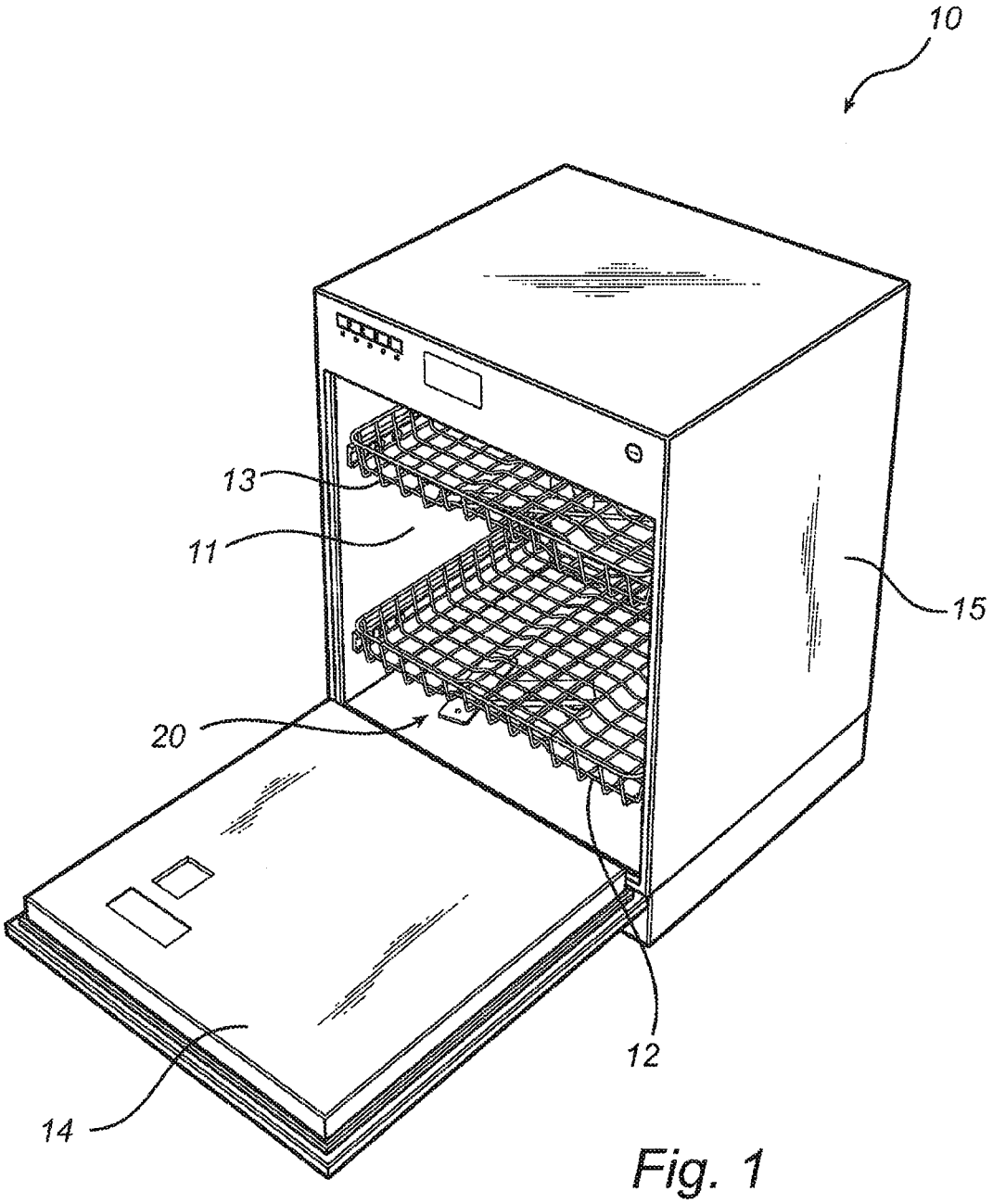
FIG. 1 is a perspective view of a dishwasher according to the invention.

A dishwasher 10 according to the invention, as illustrated in FIG. 1, comprises a housing 15 in which a treatment chamber 11 is arranged. The treatment chamber 11 has a lower and an upper basket, 12 and 13, in which dish is inserted. Below and/or above each basket 12 and 13, one or more wash arm arrangements 20 are arranged. The wash arm arrangements 20, are adapted to rotate substantially horizontally during operation of the dishwasher 10. Each wash arm arrangement is connected to a respective vertically arranged liquid supply duct, via which liquid supply duct a circulation pump distributes liquid under pressure during operation of the dishwasher (not visible in FIG. 1). Further, a door 14 for sealing the treatment chamber 11 is arranged on the housing 15.

Figure 2:
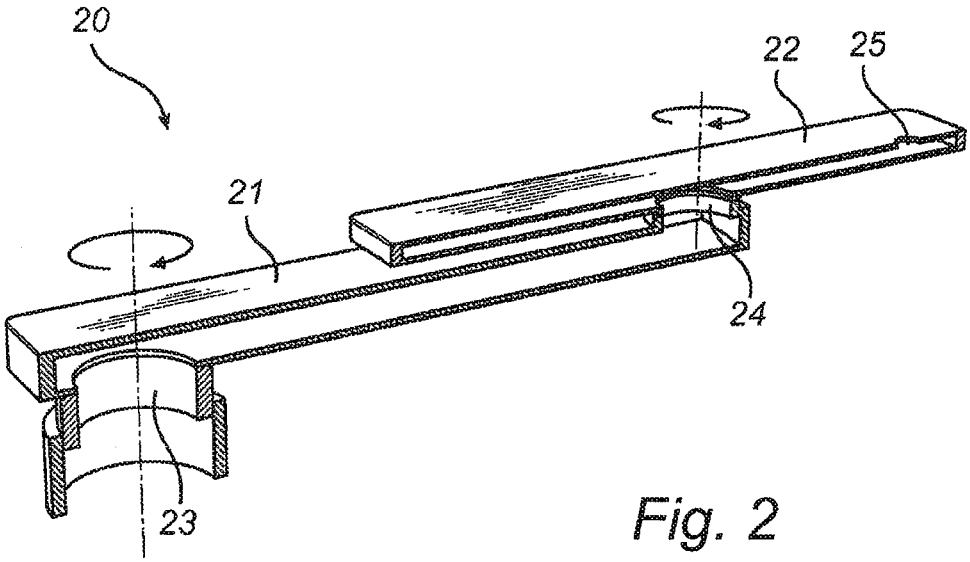
FIG. 2 is a perspective cross-sectional view of an embodiment of a wash arm arrangement according to the present invention.

An embodiment of a wash arm arrangement 20 according to the present invention is now described, with reference to FIG. 2. The wash arm arrangement 20 comprises a hollow and elongated central arm 21 with an upper and lower side. At the lower side of the central arm 21, a first shaft alley 23 functioning as a liquid inlet is arranged. The first shaft alley 23 is adapted for rotatable connection with a vertically arranged cleaning liquid supply duct arranged in the treatment chamber of the dishwasher (not shown). The cleaning liquid supply duct is typically connected to a water supply, a circulation pump and alternatively to a cleaning agent supply, and is further controlled by a control system of the dish washer. The axis of rotation of the central arm 21 is located at the center of the liquid inlet 23. In this embodiment the liquid inlet 23 is arranged at a first end of the central arm 21.

In an alternative embodiment of an elongated hollow central arm, the liquid inlet, i.e. the first shaft alley, is arranged at substantially the centre point of the central arm, or alternatively at the mass centre of the wash arm arrangement, to achieve balance during operation of the dishwasher. The latter is advantageous with respect for e.g. avoiding unwanted acoustic resonance, and for avoiding mechanical stress in the shaft alley thereby increasing the lifetime of the mechanical parts.

To continue, the central arm 21 is provided with a liquid outlet arranged at a second shaft alley 24. The second shaft alley 24 is here arranged on the upper surface of the central arm 21. However, the second shaft alley may alternatively be arranged on the same side as the first shaft alley. An elongated satellite arm 22 with an upper and lower surface is rotatably connected at a liquid inlet, arranged in its lower surface, with the second shaft alley 24. The satellite arm 22 is at least partly hollow and receives cleaning liquid via the second shaft alley 24 during operation. The satellite arm 22 is extending symmetrically in two directions from the second shaft alley 24, about which the satellite arm 22 is arranged to rotate. The axis of rotation of the satellite arm 22 is located at the center of the second shaft alley 24. At an outer end of the satellite arm 22 a collimating nozzle 25 is arranged. The collimating nozzle 25 and the second shaft alley 24 are in fluid communication. During operation cleaning liquid under pressure is distributed to the wash arm arrangement 20 from the dishwasher feeding duct via the first shaft alley 23 and into the central arm 21 and further through the second shaft alley 24 into the satellite arm 22. Cleaning liquid is subsequently outputted through the exit of the collimating nozzle 25. The collimating nozzle 25 is circular and is 6 mm in diameter. The length of the collimating nozzle is 4 mm. The collimating nozzle 25 is the only active nozzle on the washing arm arrangement 20. The definition of being active is here outputting cleaning liquid over the washing area during operation of the dishwasher.

In an alternative embodiment of the wash arm arrangement, the collimating nozzle is oval (not shown).

The diameter of the collimating nozzle 25 is selected so as to provide an unbroken, collimated jet of liquid out from the satellite arm 22. A typical spray nozzle according to known wash arm arrangements has a smaller diameter, and is arranged such that a high speed, sprinkle jet of cleaning liquid is provided to the washing area. To cover a large portion of the washing area, the shape and/or rim of the known nozzle is often selected so as to provide the sprinkle jet in a wide angle, e.g. in a sun feather distribution. In comparison with such a typical spray nozzle, in the present inventive concept, the size of the liquid output area is selected for providing a substantially uniform, homogenous jet with relatively low velocity/pressure, a large diameter, an even cross-section of the outputted jet, and thereby a large liquid volume flow. The amount of water subjected to the hit area of the jet on the wash area per time unit is thus larger than for a sprinkle jet. Thereby a more efficient cleaning of the dirty dishes is reached. The relatively wide and powerful jet provides a large cleaning liquid flow which is applicable for loosening and removing the soil.

In an alternative embodiment of a wash arm arrangement according to the present invention, the satellite arm is an elongated hollow body which is rotatably connected with the second shaft alley at a first end portion.

In an embodiment of the wash arm arrangement, the collimating nozzle 25 is skewed 8° with respect to the vertical plane of the satellite arm and in a direction perpendicular to the extension of the satellite arm such that the collimated jet outputted from the collimating nozzle 25 is inclined providing a propulsion force such that the satellite arm 22 rotates during operation. To provide a propulsion force the collimating nozzle the range of 2-20° for the inclination of the collimating nozzle is applicable. However, in addition to, or alternatively to, providing a propulsion force, the collimating nozzle can be inclined to improve the cleaning performance, by providing a liquid jet with an inclined impact towards the dishes, or for controlling the liquid jet covering of the washing area during operation.

Figure 3A:
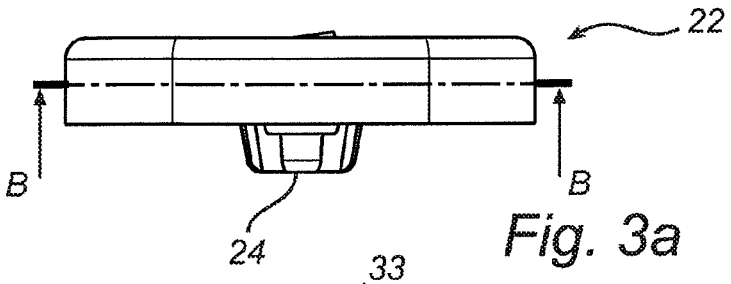
FIG. 3*a*-3*f* are cross-sectional views illustrating a satellite arm of an embodiment of a wash arm arrangement according to the present invention.
Figure 3B:
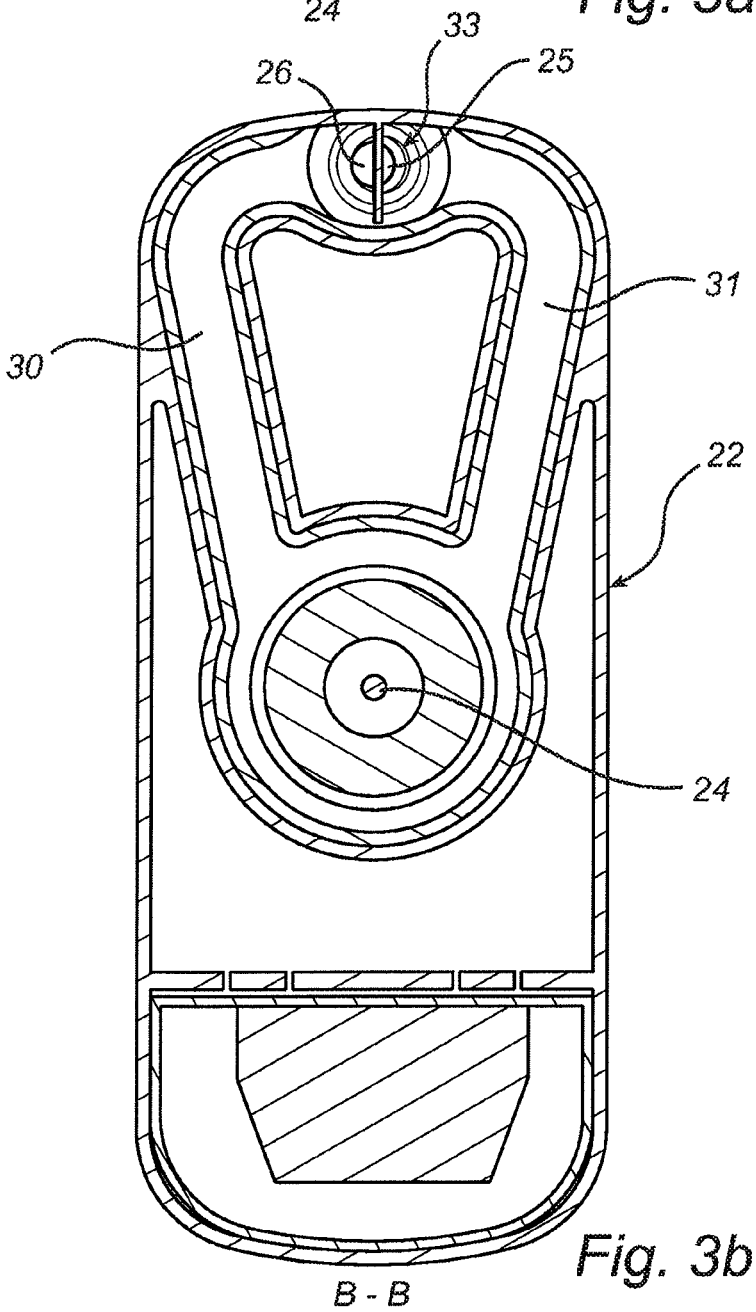
Figure 3C:
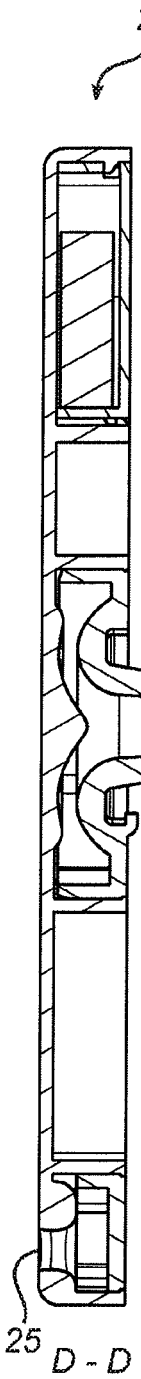
Figure 3D:
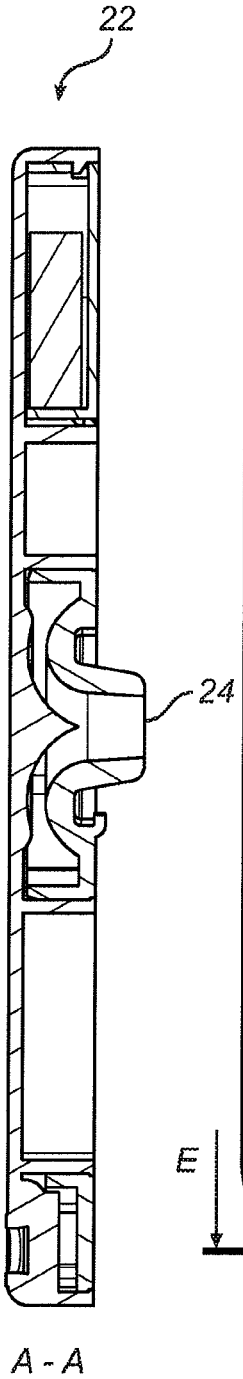
Figure 3E:
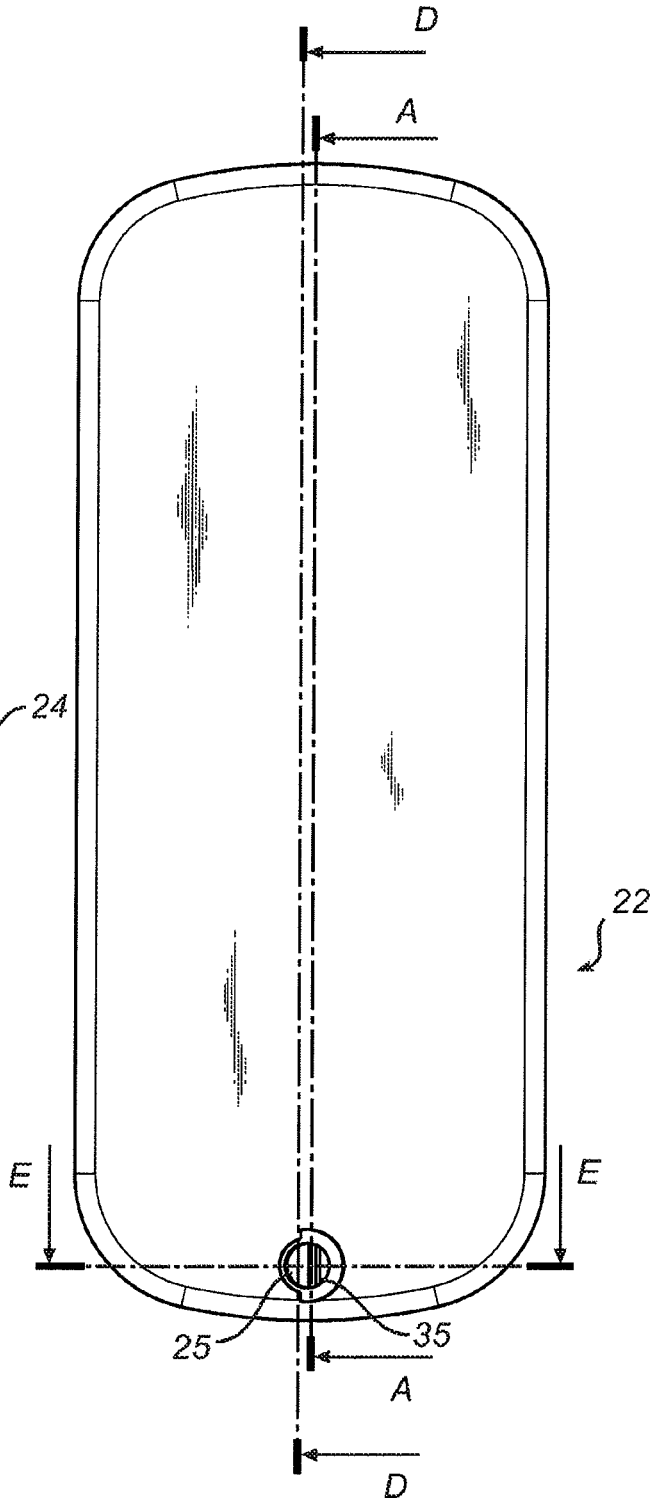
Figure 3F:
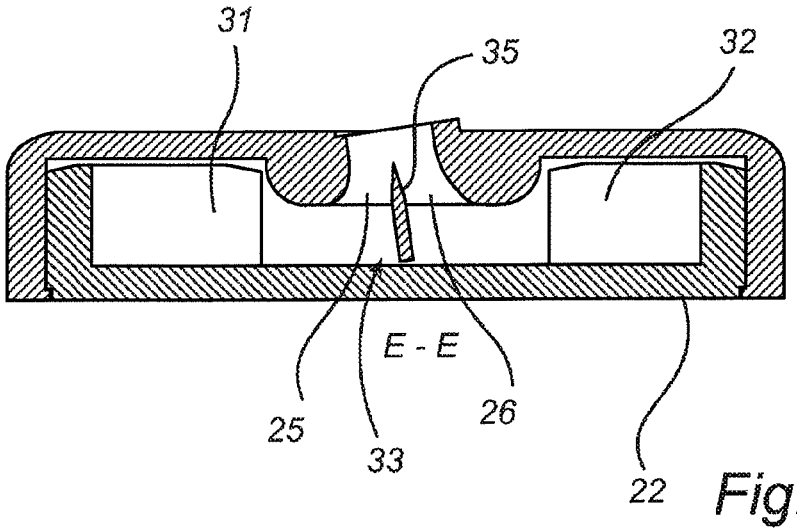

In an embodiment of the wash arm arrangement the satellite arm 22, which is described herein after with reference to FIGS. 3*a*-3*f*, the satellite arm is elongated and provided with a collimating nozzle 25 at an outer end. A liquid inlet is arranged at a second shaft alley 24, from which two separate liquid supply channels 30, 31 extend to the collimating nozzle 25, thereby providing fluid communication with the second shaft alley 24. The liquid supply channels 30,31 extend along the elongated satellite arm 22, and are at an outer portion of the satellite arm 22 curved such that the two channels 30, 31 face each other, in two opposite soft reverse J-shapes. That is, the liquid supply channels 30, 31 converge at a collimation portion 33 which is arranged at the collimating nozzle 25. Referring now to FIG. 3*f*, the collimating nozzle 25 is trumpet shaped, with concave inner surfaces 26 which form an integrated part of the collimation portion 33 together with the opposite inner surface of the hollow satellite arm 22. The concave inner surfaces 26 are arranged for facilitating guiding of the respective liquid flow from the converging liquid supply channels 30, 31, into a common direction and to merge the contributing liquid flows to form a homogenous jet as the liquid is guided out from the satellite arm via the collimating nozzle 25. The trumpet shape of the collimating nozzle 25 contributes to collimating and speeding up the outputted liquid jet. The collimating nozzle 25 is inclined, or skewed, such that its exit here is inclined 5° with respect to the upper surface of the satellite arm 22. At the collimating nozzle 25, where the two liquid supply channels, 31 and 32, meet, a separating plate 35 is arranged extending from the inner surface of the satellite arm 22 at the opposite side of the entrance to the collimating nozzle 25 into a subportion of the collimating nozzle 25, such that the separating plate 35 redirects the liquid supplied from the respective liquid supply channel 31, 32 towards the collimating nozzle 25. To facilitate the redirection of the liquid flow into the skewed collimating nozzle, the separating plate 35 is inclined with respect to the normal of the upper surface of the satellite arm 22 such that the inclination of the separation plate 35 coincides with the normal of the exit of the collimating nozzle 25. The separation plate 35 is provided with a wedge shaped upper edge. As the upper edge is inserted in the nozzle the wedge facilitates the merging of the liquid flow from the two liquid supply channels 31,32.

In an alternative embodiment of the wash arm arrangement, concave inner surfaces may further be arranged on the inner surfaces of the collimation portion opposite to the collimating nozzle to facilitate the guiding of the liquid flow towards the collimating nozzle.

Figure 4A:
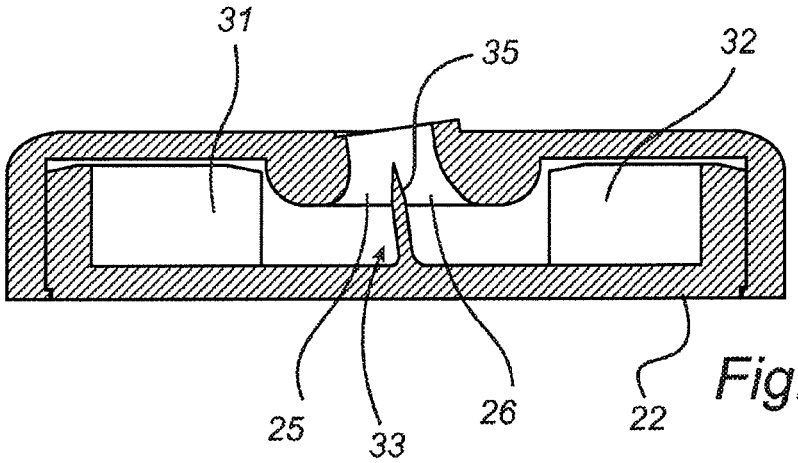
FIG. 4*a*-4*b* illustrate cross-sectional side views of satellite arms of embodiments of wash arm arrangements according to the present invention.
Figure 4B:
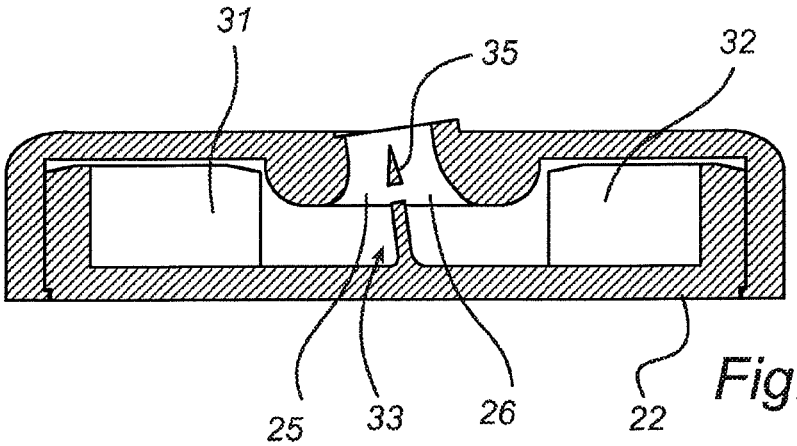

In a satellite arm 22 according to an embodiment of the wash arm arrangement, as illustrated in FIG. 4*a*, the separating plate 35 is arranged basically as described above. However, the separating plate 35 is here integrated with the inner surface of the satellite arm 22. The inner surfaces opposite to the collimating nozzle then meet to form the separating plate 35. The inner surface may then be designed to further control the direction of the contributing liquid flow from the two liquid supply channels 31, 32 towards the collimating nozzle 25, e.g. a combination of the separating plate 35 and concave inner surfaces can be utilized. A further variant of the redirection element 35 is illustrated in FIG. 4*b*, in which the redirection element is divided such that it is partly integrated with the inner surface opposite to the collimating nozzle 25 and partly a free standing part which is arranged inside (and partly attached to) the collimating nozzle 35.

In an embodiment of the wash arm arrangement, the collimating nozzle is shaped like a hollow, truncated cone with its wider base arranged facing the collimation portion, and its truncated top portion arranged as an exit for the liquid jet formed in the collimation portion. The tapering of the collimating nozzle increases the speed of the liquid as it moves towards the exit. In an alternative embodiment, the collimating nozzle is funnel shaped (not shown).

In further alternative embodiments, the tapering of the cone shaped or trumpet shaped nozzle, is arranged in a plurality of steps.

In embodiments of the invention, the diameter of the collimating nozzle is preferably selected in a range between 3.5 to 7.5 mm to provide a high liquid flow over the washing area, such that loosened dirt on the dish is properly rinsed off and transported out from the treatment chamber drain (not shown).

In an alternative embodiment of the wash arm arrangement, an additional collimating nozzle is arranged on an opposite end of the satellite arm, to provide a balanced wash arm arrangement. In this embodiment (not shown), the liquid supply to the respective collimating nozzle, may be provided with a respective set of liquid supply channels as described with reference to FIG. 3*b*. The "twin" collimating nozzles are each arranged to output a collimated liquid jet. The additional collimating nozzle may be arranged at a radial distance from the second shaft alley which differs from the corresponding radial distance of the collimating nozzle to provide a more dense tracing pattern during the rotation of the wash arm arrangement on the washing area.

Above, embodiments of the wash arm arrangement according to the present invention as defined in the appended claims have been described. These should be seen as merely non-limiting examples. As understood by a skilled person, many modifications and alternative embodiments are possible within the scope of the invention.

It is to be noted, that for the purposes of this application, and in particular with regard to the appended claims, the word "comprising" does not exclude other elements or steps, that the word "a" or "an", does not exclude a plurality, which per se will be apparent to a person skilled in the art.

The invention claimed is:

1. A wash arm arrangement for a dishwasher comprising:

a central arm adapted to be rotatably connected with a first shaft through which liquid under pressure is fed into said central arm during operation; and at least one satellite arm having a liquid inlet, said liquid inlet being rotatably connected with a second shaft arranged on said central arm for supplying liquid to said satellite arm during operation;

said at least one satellite arm comprising a collimating nozzle with an exit, said collimating nozzle being arranged for providing a collimated jet for distributing liquid to a washing area of said dishwasher, and said collimating nozzle being the only active nozzle on the wash arm arrangement for outputting cleaning liquid over the washing area during operation of the dishwasher.

2. The wash arm arrangement according to claim 1, wherein said exit is arranged having a predetermined diameter selected for outputting a collimated jet of liquid with a substantially uniform cross-section.

3. The wash arm arrangement according to claim 2, wherein said predetermined diameter is selected within a range of 3.5-7.5 millimeters.

4. The wash arrangement according to claim 1, wherein said collimating nozzle is shaped like a hollow, truncated cone or trumpet bell, of which the truncation is arranged for providing said exit for said collimated liquid jet.

5. The wash arm arrangement according to claim 1, wherein said satellite arm is arranged having at least two separate liquid supply channels arranged to provide fluid communication between said liquid inlet and said collimating nozzle, said liquid supply channels converging at a collimation portion arranged at said collimating nozzle.

6. The wash arm arrangement according to claim 5, wherein said collimation portion comprises a control element for redirecting liquid supplied via each one of said liquid supply channels into a common direction.

7. The wash arm arrangement according to claim 6, wherein said control element is further arranged for merging liquid supplied via each one of said liquid supply channels into a common jet.

8. The wash arm arrangement according to claim 5, wherein the at least two separate liquid supply channels comprise at least two distinct, elongate tubes within the satellite arm.

9. The wash arm arrangement according to claim 1, wherein said collimating nozzle is arranged to provide a propulsion force for driving at least the rotation of said satellite arm around its axis of rotation during operation.

10. The wash arm arrangement according to claim 9, wherein said collimating nozzle is skewed to provide said propulsion force.

11. The wash arm arrangement according to claim 10, wherein said collimating nozzle is skewed between 2-20° with respect to a vertical plane of the satellite arm.

12. The wash arm arrangement according to claim 11, wherein said satellite arm is arranged having at least two separate liquid supply channels arranged to provide fluid communication between said liquid inlet and said collimating nozzle, said liquid supply channels converging at a collimation portion arranged at said collimating nozzle, further comprising a control element for redirecting liquid supplied via each one of said liquid supply channels into a common direction; wherein the control element is skewed with respect to a vertical plane of the satellite arm.

13. The wash arm arrangement according to claim 1, wherein said collimating nozzle is arranged at an outer end of said satellite arm.

14. The wash arm arrangement according to claim 1, wherein said second shaft is arranged at an outer end of said central arm.

15. A dishwasher comprising at least one wash arm arrangement according to claim 1.

* * * * *